US008317429B2

(12) United States Patent
Danskine et al.

(10) Patent No.: US 8,317,429 B2
(45) Date of Patent: Nov. 27, 2012

(54) CONNECTOR FOR CONNECTING FLOTATION DEVICES OR OTHER STRUCTURES

(75) Inventors: Allen Danskine, Bow, WA (US); David H. Rytand, Anacortes, WA (US)

(73) Assignee: David Rytand, Anacortes, WA (US)

( * ) Notice: Subject to any disclaimer, the term of this patent is extended or adjusted under 35 U.S.C. 154(b) by 696 days.

(21) Appl. No.: 12/253,811

(22) Filed: Oct. 17, 2008

(65) Prior Publication Data

US 2009/0116909 A1 May 7, 2009

Related U.S. Application Data

(60) Provisional application No. 61/002,220, filed on Nov. 6, 2007.

(51) Int. Cl.
*B63B 35/38* (2006.01)

(52) U.S. Cl. ..... 405/219; 29/525.04; 114/263; 403/224; 403/228

(58) Field of Classification Search ..... 405/26, 405/218–220; 114/258, 263; 403/220, 228; 29/525.04

See application file for complete search history.

(56) References Cited

U.S. PATENT DOCUMENTS

| | | | | |
|---|---|---|---|---|
| 3,047,937 | A * | 8/1962 | De Vecchi | 29/525.04 |
| 4,453,488 | A * | 6/1984 | Watchorn | 114/266 |
| 4,683,833 | A | 8/1987 | Meriwether | |
| 4,703,967 | A | 11/1987 | Killgrove | |
| 4,850,771 | A * | 7/1989 | Hurd | 29/525.04 |
| 4,852,509 | A * | 8/1989 | Fransen et al. | 114/263 |
| 4,962,716 | A * | 10/1990 | Fransen et al. | 114/263 |
| 5,257,593 | A * | 11/1993 | van den Elshout et al. | 114/263 |
| 5,529,012 | A * | 6/1996 | Rytand | 114/263 |
| 6,102,610 | A * | 8/2000 | Palusis et al. | 403/388 |
| 6,450,737 | B1 * | 9/2002 | Rytand et al. | 405/219 |
| 7,273,018 | B2 * | 9/2007 | Strong | 114/266 |
| 7,640,881 | B1 * | 1/2010 | Gerst et al. | 114/263 |
| 2002/0067957 | A1 * | 6/2002 | Rytand et al. | 405/219 |
| 2007/0017427 | A1 * | 1/2007 | Rytand | 114/263 |
| 2009/0320736 | A1 * | 12/2009 | Gerst et al. | 114/263 |

* cited by examiner

*Primary Examiner* — Tara Mayo-Pinnock
(74) *Attorney, Agent, or Firm* — Klarquist Sparkman, LLP

(57) ABSTRACT

Connectors having redundant fasteners for interconnecting adjacent structures are disclosed. Some connectors have first and second bearing bodies and a member disposed between the bearing bodies. A first fastener is held in tension and extends through the bearing bodies and the member. The tension in the first fastener urges the bearing bodies against each other in compression. A second fastener held in loose engagement relative to the bearing bodies and the member extends through the bearing bodies. On release of the tension in the first fastener, such as by failure of the first fastener, the second fastener is placed in tension.

25 Claims, 4 Drawing Sheets

CONNECTOR FOR CONNECTING FLOTATION DEVICES OR OTHER STRUCTURES

CROSS REFERENCE TO RELATED APPLICATION

This application claims priority to and the benefit of U.S. Provisional Patent Application 61/002,220, filed Nov. 6, 2007, which is incorporated herein by reference.

FIELD

The following disclosure concerns connectors having redundant fasteners for connecting two structures, for example adjacent flotation devices such as floating dock sections.

BACKGROUND

Conventional coupling mechanisms for floating docks are normally designed with a coupler restricting several degrees of freedom of motion. However, most floating docks are exposed to loads of varying magnitude in each of the six degrees-of-freedom. Accordingly, loads in individual members of conventional coupling mechanisms can be quite large, contributing to rapid deterioration in effectiveness, and sometimes outright failure, of the coupling mechanism.

In addition, loads resulting from wave action, or other loads, sometimes result in structural damage to one or more dock sections since the loads are exerted on the structural members of the dock rather than being dissipated through movement or absorbed by the coupling mechanism.

Although conventional coupling mechanisms have resolved these issues in the past to varying degrees of success, none have incorporated a combination of primary and redundant fasteners. U.S. Pat. No. 4,453,488 to Watchorn discloses a connector for joining structural components using a plurality of similarly tightened bolts. Accordingly, failure of conventional coupling mechanisms, including those of Watchorn, usually results in one or more dock sections becoming partially or completely detached from an adjacent dock section.

Thus, there is a need for connecting apparatus that provide relative movement between interconnected dock sections together with redundant connection in the event that a coupling member fails.

SUMMARY

Disclosed herein are apparatus and methods for redundantly connecting structures such as flotation devices, for example floating dock sections, bridges and walkways.

According to a first aspect, connectors for interconnecting first and second flotation devices comprise first and second bearing bodies coupled to the first and second flotation devices, respectively. Such connectors include a member disposed between the bearing bodies and a first fastener held in tension and extending through the bearing bodies and the member. A second fastener is held in loose engagement relative to the bearing bodies and the member and extends through the bearing bodies and the member. Upon failure of the first fastener, the first and the second flotation devices separate sufficiently to place the second fastener in tension.

In some instances, the member comprises an expandable member configured to urge the first and the second flotation devices apart upon failure of the first fastener. The member can comprise an elastomeric shear bushing. At least one of the bearing bodies can comprise a steel plate.

Some embodiments according to the first aspect also include a compression member, through which the first fastener passes. The compression member is capable of deforming under variable loading of the first fastener to allow a degree of movement between the dock sections.

Connectors according to the first aspect can also comprise at least one housing disposed in a recess of each flotation device. The housing can define a top portion, a bottom portion, a side portion and an end portion. The top portion and the bottom portion can be substantially parallel to each other and the side portion and the end portion can extend perpendicularly to each other and between the top portion and the bottom portion. In such embodiments, the first bearing body can extend vertically between the top portion and the bottom portion and substantially parallel to the end portion. In some instances, the top, the bottom and the side are formed by a U-shaped channel, and the end comprises a plate welded to the U-shaped channel.

At least one fastener can comprise a bolt. Some embodiments according to the first aspect comprise a tensioning mechanism for placing the first fastener in tension. For example, a first nut can threadably engage the first fastener, and a keeper nut can threadably engage the first fastener and tighten against the first nut to prevent the first nut from loosening.

According to a second aspect, floating dock assemblies are disclosed that comprise a first dock section, a second dock section and at least one connector for connecting the first and the second dock sections to each other. The connector comprises first and second bolts spanning a joint between the dock sections. The first bolt is placed in tension to apply a compressive load between the dock sections, and the second bolt is held in loose engagement with the dock sections so as not to apply a load to the dock sections. Failure of the first bolt causes the second bolt to be placed in tension and apply a compressive load between the dock sections.

In some instances, the at least one connector comprises first and second connectors. Some embodiments include a member held in compression by the compressive load between the dock sections. The member can comprise an expandable member. Some floating dock assemblies include a compression member disposed on the first bolt to minimize stress of the first bolt caused by relative movement between the dock sections.

According to a third aspect, methods are disclosed that comprise disposing a member between opposing first and second bearing bodies and compressing the member between the bearing bodies with a first fastener. Such methods further include loosely engaging the bearing bodies with a second fastener. A first load in the first fastener maintains the member in compression. The second fastener can be placed under a second load on release of the first load.

The member can comprise an expandable member that can expand to at least partially place the second fastener under the second load. In some instances, the first fastener comprises a bolt and the first load comprises a tensile load. The second fastener can comprise a bolt, and the second load can comprise a tensile load less than the first load.

Some exemplary methods also comprise placing the second fastener under a replacement load substantially the same as the first load, and replacing the first fastener with a third fastener. The third fastener can be placed under a load substantially the same as the second load on release of the replacement load. In some instances, the replacement load comprises a tensile load and the third fastener comprises a bolt.

According to a fourth aspect, flotation assemblies are disclosed that comprise a first flotation device having a first bearing plate and a second flotation device having a second bearing plate. An elastomeric shear bushing is disposed between the first and second bearing plates and a first bolt extends through the first and the second plates and the bushing. The first bolt is held in tension such that the bushing is held between the first and second plates. A second bolt extends through the first and second plates and the bushing. The second bolt is held in loose engagement such that, on failure of the first bolt, the second bolt is placed in tension.

In some instances, the bushing is configured to expand on failure of the first bolt. Flotation assemblies also can comprise a tensioning mechanism for holding the first bolt in tension. The tensioning mechanism can comprise a first nut engaging threads on the first bolt and tightened to place the first fastener in tension. The tensioning mechanism can also comprise a keeper nut tightened against the first nut.

Some flotation assemblies comprise a cover pivotally connected to one of the dock sections to provide access to one or more of the bolts.

In some instances, flotation assemblies further include a compression member through which the first bolt extends. The first bolt further comprises a head disposed at an end of the bolt. The compression member is disposed on the first bolt between the head and the first plate and is capable of deforming under variable loading of the first bolt to minimize stress on the first bolt caused by relative movement between the flotation devices.

Some flotation assemblies comprise first and second housings disposed in respective recesses in the first and second flotation devices, respectively. The first and second bearing plates are secured to the first and second housings, respectively. In such assemblies, the bushing desirably is at least partially disposed in the first and second housings.

In some instances, the first and second flotation devices are concrete structures.

According to a fifth aspect, flotation assemblies are disclosed that comprise a first flotation device defining a first pair of recesses on opposing sides of a first end thereof and a second flotation device defining a second pair of recesses on opposing sides of a second end thereof. The first and the second ends oppose each other, and each of the first pair of recesses opposes a corresponding one of the second pair of recesses.

Flotation assemblies according to the fifth aspect comprise at least four connector housings. Each connector housing is disposed in a corresponding recess of a flotation device to form at least two pairs of opposing connector housings. A primary bolt joins one of the pairs of opposing connector housings. A redundant bolt is held in loose engagement. On failure of the first bolt, the first and second flotation devices separate sufficiently to place the second bolt in tension.

Such flotation assemblies can also include a member corresponding to and disposed between each pair of opposing connector housings. On failure of the first bolt, the expandable member can expand to place the second bolt in tension.

The foregoing and other features, and advantages of the invention will become more apparent from the following detailed description, which proceeds with reference to the accompanying figures.

DETAILED DESCRIPTION

The following describes embodiments of connecting apparatus for connecting adjacent flotation devices, such as adjacent floating dock sections.

The following makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, etc.) may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object.

Accordingly, the following detailed description shall not be construed in a limiting sense and the scope of property rights sought shall be defined by the appended claims and their equivalents.

Figure 1:
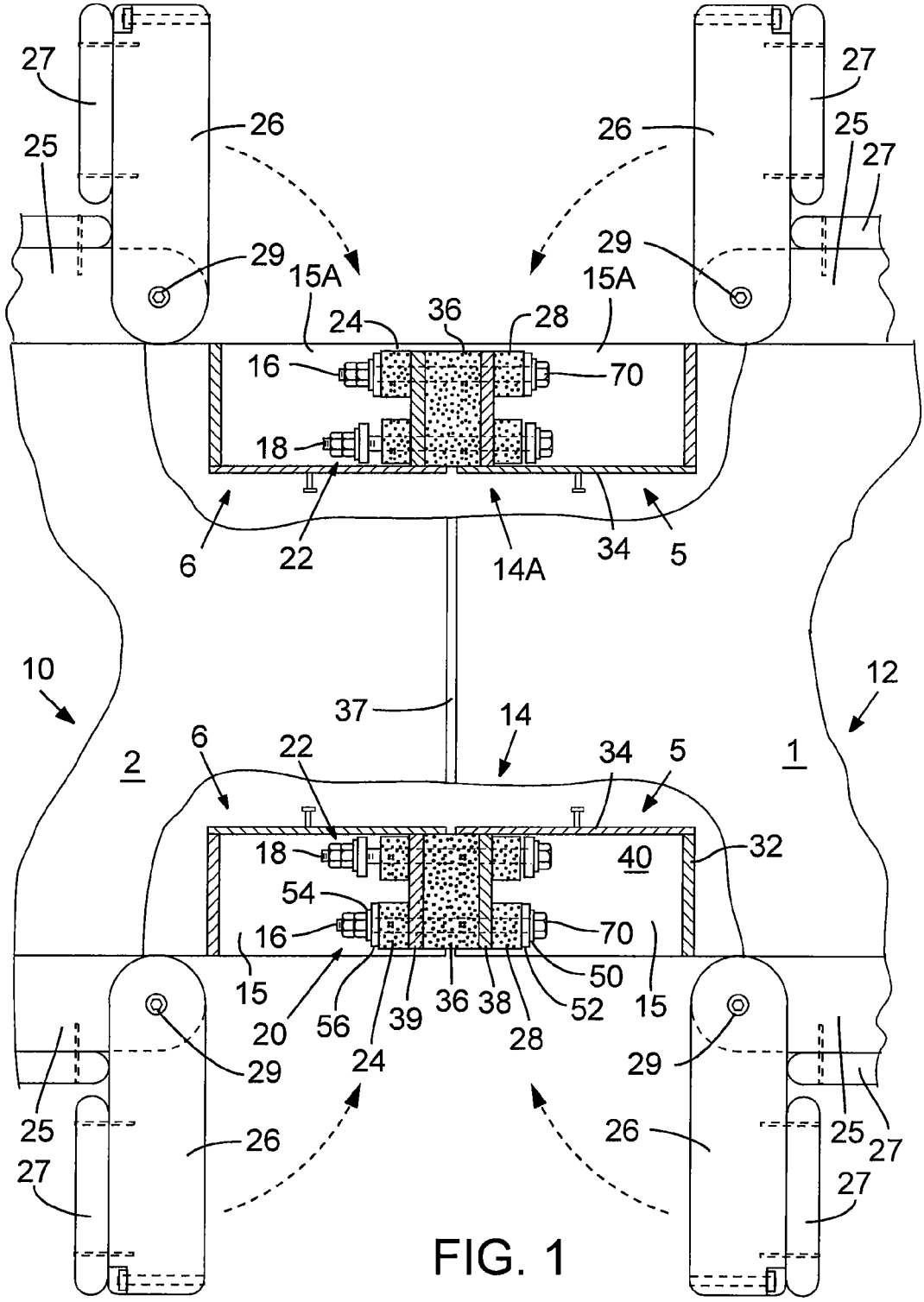
FIG. 1 illustrates a top plan view of an exemplary joint between adjacent floating dock sections joined by an exemplary connecting apparatus.
Figure 2:
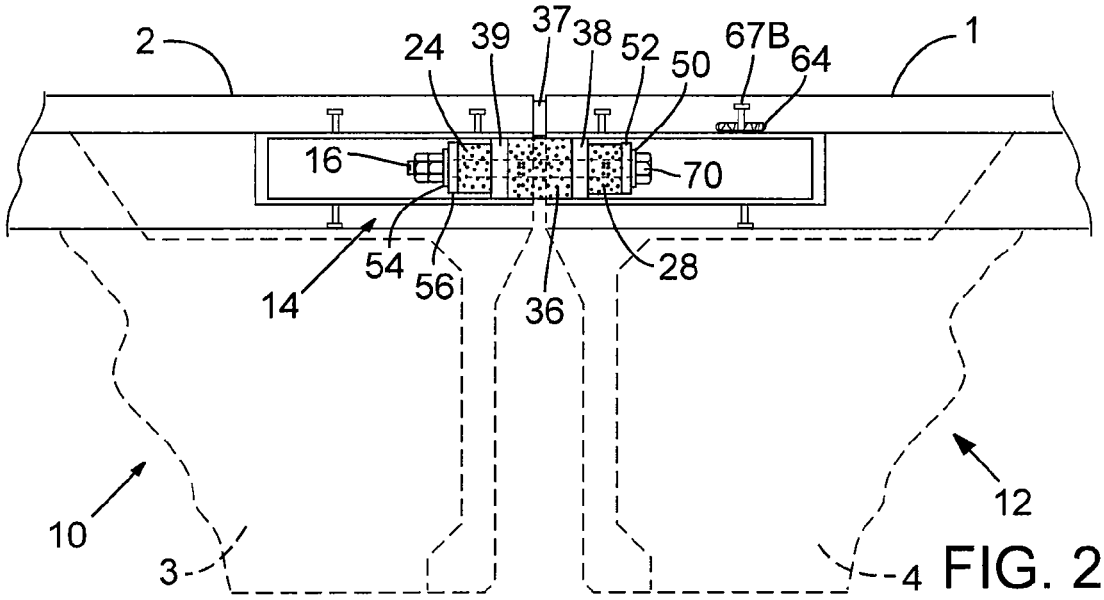
FIG. 2 illustrates a side elevation of the joint of FIG. 1 shown with the rubstrips removed for purposes of illustration.

FIG. 1 illustrates a first dock section 10 such as a floating dock section, which can be a concrete dock section having a recess for receiving a self-centering flotation core 3 (as shown by FIG. 2). Also shown is a second dock section 12, similar to the first dock section 10. Although floating dock sections are not described in detail here, floating dock sections are well known. For example, U.S. Patent Publication No. 2002/0067957 describes several exemplary embodiments of floating dock sections and U.S. Pat. Nos. 5,529,012 and 6,450,737 refer to several other embodiments. These patent documents are incorporated herein by reference.

As shown, opposing ends of the dock sections 10, 12 are desirably connected by first and second connectors 14, 14A, which are located on opposite edges of the dock sections from each other. In the illustrated embodiment, the dock sections 10, 12 are joined end to end by two connectors 14, 14A such that the respective deck surfaces 2, 1 are in substantial alignment and are substantially co-planar with each other. Although not shown, one connector can be used to join adjacent flotation devices in some embodiments. In addition, one or more connectors 14 can be used to connect the side of one flotation device to the side of another flotation device in a side-to-side configuration, or to connect the end of one flotation device to the side of another flotation device, such as in a T-shaped or an L-shaped configuration.

Typical of connectors as presently disclosed, one or more components of a connector 14, 14A, such as a fastener, can fail and the connector 14, 14A can still provide a connection between the adjacent dock sections 10, 12, as described more fully below. The connectors 14, 14A are desirably disposed in respective recesses 15, 15A formed in the upper surfaces of the deck sections. Each recess in the illustrated embodiment is open at the end of one side of the respective deck section.

The illustrated connectors 14, 14A can each have a member 36 held in compression between a bearing body 39 corresponding to the first dock section 10 and a second bearing body 38 corresponding to the second dock section 12. In some embodiments, the member 36 is an elastomeric shear bushing. In some embodiments, the member 36 can deform when placed in compression and exert an outward force. As shown in FIG. 1, the bearing bodies can be plates and can be incorporated into housings, such as the housings 5, 6 disposed in corresponding recesses defined by the dock sections. Exemplary housings are described more fully below.

Each connector 14, 14A has a first fastener 16 placed in tension to apply compression between the housings 5 and 6. A second fastener 18 of each connection is held in loose engagement relative to the dock sections 10, 12, such that if the first fastener 16 fails, first and second dock sections 10, 12 separate sufficiently to place the second fastener 18 in tension. As used herein, "separate sufficiently" means a distance that two adjacent structures (e.g., dock sections) drift apart a finite distance when tension in a primary fastener is released, as by fracture of a bolt acting as a primary fastener. In some instances, the corresponding member 36 can expand to place the second fastener 18 in further tension.

Exemplary of the fasteners 16, 18 are longitudinally extending fasteners, such as bolts. In one embodiment, the fasteners 16, 18 are 1½-inch diameter F1554 GR 105 bolts, although the type and size of the bolts can vary depending on the particular application. For example, the bolt size can be increased to interconnect heavier dock sections.

One embodiment of a member 36 is an elastomeric shear bushing, such as a bushing formed of a material having 90-durometer hardness. The member 36 can be made of rubber or any of various other suitable elastomers. In some embodiments, shear bushings do not deform substantially in compression or expand substantially when released from compression, as when tension in the first fastener 16 is released. Nonetheless, in other embodiments, the expandable member can expand to urge the dock sections 10, 12 apart from each other to place the second fastener in tension when the primary fastener, e.g., the first fastener 16, fails.

As shown in the illustrated embodiment, a first tensioning apparatus 20 places the first fastener 16 in tension, as more fully described below. Placing the first fastener 16 in tension can place the member 36 in compression between the dock sections 10, 12 and assists in joining the dock sections to each other. In this instance, the first fastener 16 can be referred to as a primary fastener.

A similar, second tensioning apparatus 22 holds the second fastener 18 in loose engagement relative to the dock sections 10, 12, making the second fastener 18 a secondary, or redundant, fastener. As used herein, a fastener being held in "loose engagement" means that the tensioning apparatus is not tightened or only hand tightened so that the fastener applies very little, if any, load to the connector.

When held in loose engagement relative to the dock sections 10, 12, the second fastener 18 will be placed in tension if either the second tensioning apparatus is tightened to urge the dock sections 10, 12 against each other or if tension in the primary fastener is released, as by a fracture, and the dock sections separate sufficiently. Usually when the sections 10, 12 separate following a failure of the first fastener 16, the tension in the second fastener 18 will be slightly less than the tension originally present in the first fastener 16. Nonetheless, the tension in the second fastener 18 is sufficient to form a secure connection between the dock sections.

Although not required, after loading of the second fastener 18, such as by a failure of the first fastener 16, the second tensioning apparatus 22 can be adjusted to increase tension in the second fastener 18 as desired to reduce deflection. The secondary fastener becomes the primary fastener when placed in tension by a release of tension in the first fastener 16 (e.g., when the first fastener 16 fails), and a third fastener (not shown) can be installed to replace the failed first fastener 16, making the third fastener the secondary or redundant fastener held in loose engagement relative to the dock sections.

Figure 6:
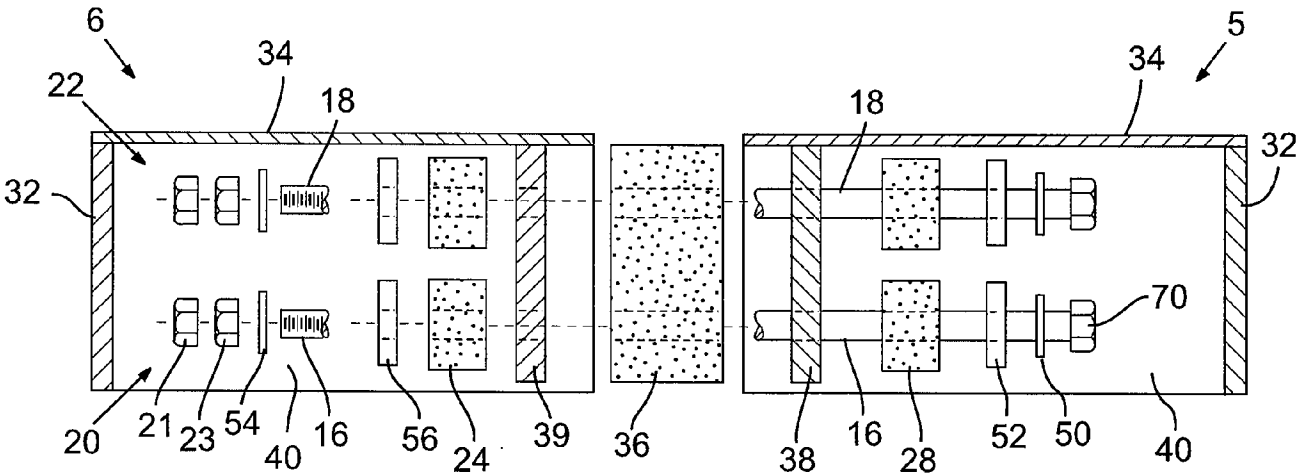
FIG. 6 illustrates a partially exploded view of an exemplary connecting apparatus similar to that shown in FIG. 1.

With reference to FIGS. 1, 2 and 6, which illustrate various views of a connector 14, the first fastener 16 extends longitudinally from the first tensioning apparatus 20, through apertures formed in a first bearing member 54, a second bearing member 56, a first compression member, or bushing, 24, a first bearing body 39 (corresponding to the first dock section 10), a second bearing body 38 (corresponding to the second dock section 12), a second compression member, or bushing, 28, a third bearing member 52 and a fourth bearing member 50. The end portion, or head, 70 of the fastener 16 bears against the fourth bearing member 50 when the fastener 16 is placed in tension.

Tension in the first fastener 16 places the compression members, or bushings, 24, 28 at least in part, in compression, urging the first compression member against the first bearing body 39 and the second compression member against the second bearing body 38. As noted above, the bearing bodies 38, 39 can be flat plates made from a suitable material, such as steel.

Incorporating compression members 24, 28 allows a degree of relative movement between the dock sections 10, 12. In other words, the compression members are capable of deforming under variable loading of the primary fasteners, such as when the interconnected dock sections 10, 12 undergo movement relative to each other, as can occur in response to wave action, for example when a boat wake passes beneath the dock sections, and therefore reduce the amount of impact force transferred to the fasteners 16, 18.

Although the illustrated fastener 16 is a bolt with a unitary body and head forming the end portion 70, other embodiments of fasteners have other configurations. For example, an externally threaded rod can form the fastener 16 and can receive one or more nuts that tighten against the fourth bearing member 50. In this example, such one or more nuts form the end portion 70, replacing the bolt head.

The illustrated first and fourth bearing members 54, 50 are round washers, with hardened round washers being an example. The illustrated second and third bearing members 56, 52 are plate washers, such as ½-inch thick by 4½-inch diameter plate washers. The illustrated compression members 24, 28 are elastomeric bushings, such as, for example, five-inch diameter crush bushings formed of a material having approximately 90-durometer hardness, such as 90-durometer rubber.

The exemplary second fastener 18 extends longitudinally through a similar arrangement of bearing and compression members. As noted above, the second tensioning apparatus 22 holds the second fastener 18 under little or no tension when initially assembled. For example, the second tensioning apparatus 22 can be tightened by hand. However, the tensioning apparatus 22 will hold the second fastener 18 in tension if the first fastener 16 fails and the expandable member 36 expands.

Figure 3:
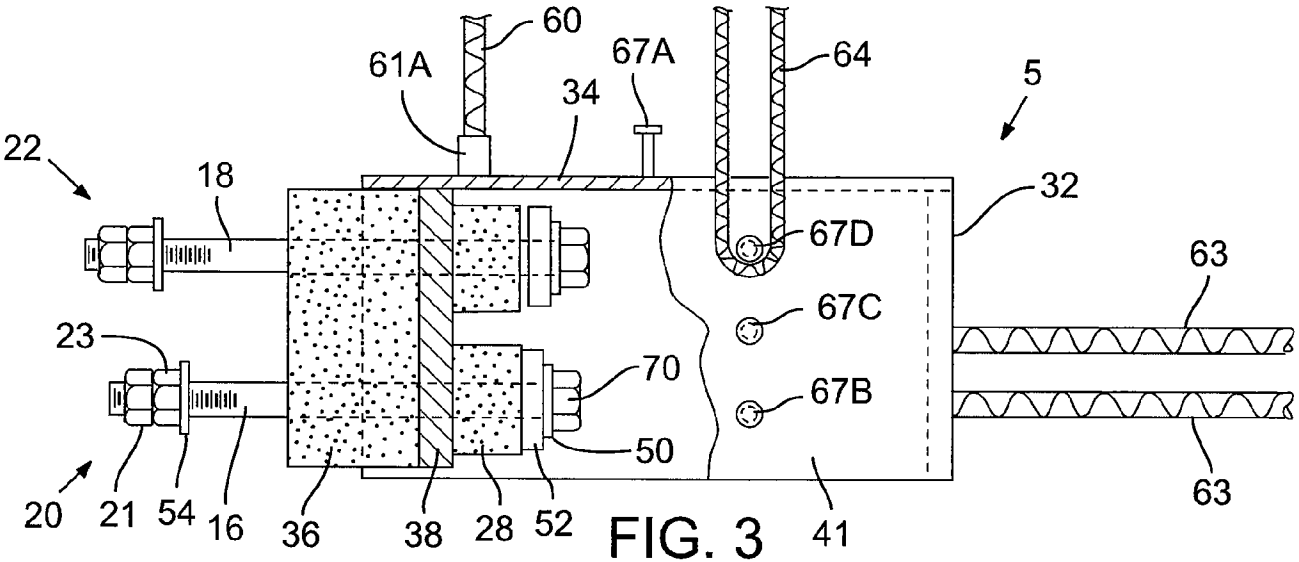
FIG. 3 illustrates a top plan view of a portion of an exemplary connecting apparatus similar to that shown by FIG. 1.

As best shown in FIG. 3, the illustrated first tensioning apparatus 20 can be one or more nuts, such as a first nut 23 that bears against the first bearing member 54 and a keeper nut 21 that is tightened against the first nut 23 to prevent the first nut 23 from loosening. In such an embodiment, the first nut 23 is sufficiently torqued, such as by using a wrench or other tool, and the keeper nut 21 is then sufficiently torqued against the first nut 23. In other embodiments, the tensioning apparatus 20 can be a single nut in combination with a lock washer. In still other embodiments, the tensioning apparatus can be a locking nut, with a Nylok nut being an example.

The second tensioning apparatus 22 also can include a first nut 23 and a second keeper nut 21. When initially installed, the second tensioning apparatus 22 can be placed in loose engagement with the fastener 18 by not tightening, or only hand tightening, the nuts.

Because of the similarity between the housings 5 and 6, the construction of only the second housing 5 will be described in detail.

Figure 4:
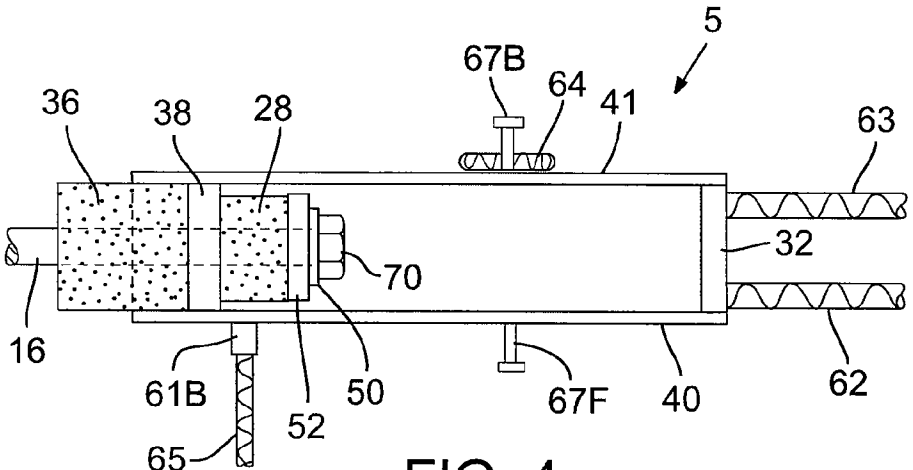
FIG. 4 illustrates a side elevation of the portion of the connecting apparatus shown in FIG. 3.
Figure 5:
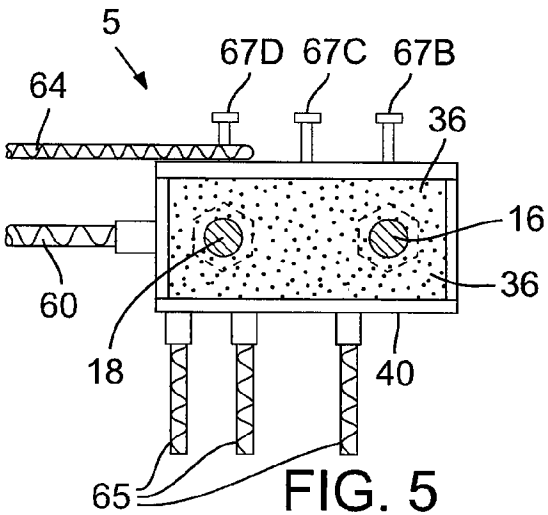
FIG. 5 illustrates an end elevation of the portion of the connecting apparatus shown in FIG. 3.

With reference to FIGS. 3-5, the second housing 5 defines a partially enclosed housing leaving one side substantially open for access to the fasteners 16, 18 from the side of the dock section 12. The illustrated housing has four substantially planar sides, namely, an end portion 32, a bottom portion 40, a top portion 41 and an inboard side portion 34. The top portion 41 and bottom portion 40 are substantially parallel to each other and the end portion 32 and side portion 34 extend perpendicularly to each other and between the top 41 and bottom 40. In this embodiment, the bearing body 38 extends vertically between the top portion 41 and bottom portion 40 opposite the end portion 32. In the illustrated embodiment, the end portion 32, side portion 34, bottom portion 40 and top portion 41 and bearing body 38 are formed of steel plates welded to each other to form the configuration shown. In other embodiments, steel channel, e.g., a U-shaped channel can form two or more of the sides 32, 34, 40, 41, and a steel plate welded to the interior of the U-shaped channel can form the bearing body 38.

As shown in FIG. 1, the open side of the housing can be covered by an end portion 26 of a side rail 25 running along an upper edge of the dock. The end portion 26 forms a door or cover for the housing and can be pivotally connected to the rail, for example by a hinge 29, such that the end portion 26 can be pivoted open to provide access to the fasteners through the open side. The side rail 25 can comprise a GLULAM beam fastened to the side of the dock section and can have elastomeric rub strips 27 mounted on its outer surface.

Figure 7:
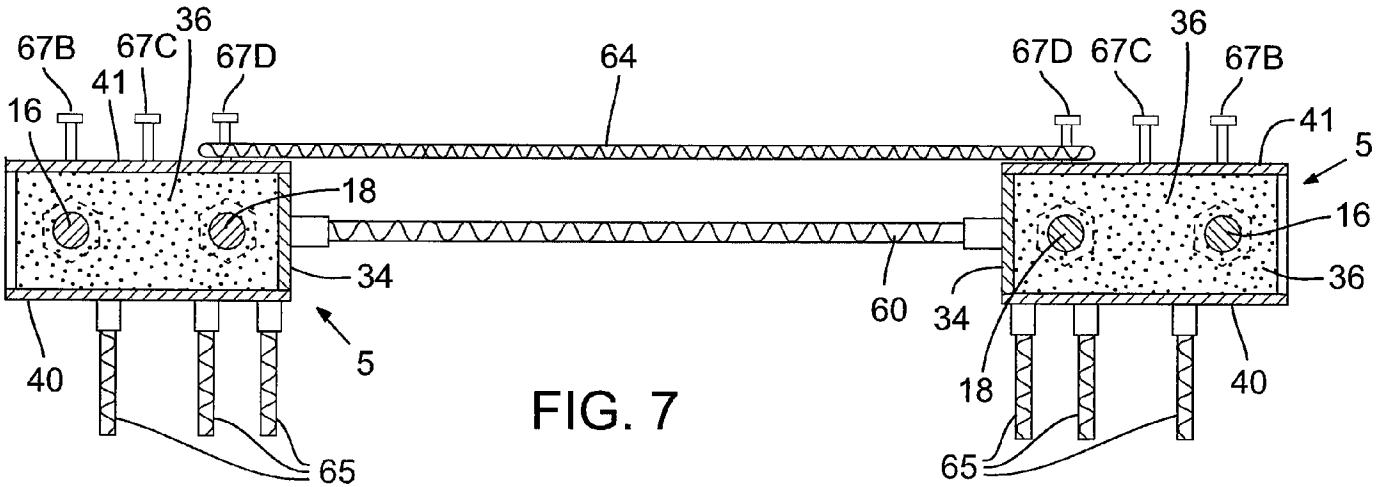
FIG. 7 illustrates an end elevation of a portion of the exemplary connecting apparatus shown in FIG. 3.

As shown in FIGS. 2-5, a housing 5 can have outwardly extending members or anchors for fixedly attaching the housing 5 to the respective dock section 12. For example, as best shown in FIG. 3, the illustrated side portion 34 has a stud 67A and a concrete reinforcing member 60, such as rebar extending therefrom. The concrete reinforcing member 60 can be fixedly attached to the side-plate 34 by a coupler 61A. As shown in FIG. 7, the reinforcing member 60 can extend transversely (widthwise) through the dock section 12 and can be secured to the housing 5 on the opposite side of the dock section.

In some embodiments, the bottom portion 40 can also have one or more studs and/or concrete reinforcing members to assist in securing the housing to the dock section. The illustrated bottom portion 40, for example, has a single stud 67F and three pieces of rebar 65 fixedly attached to the bottom 40 using rebar coupler nuts 61B.

Some embodiments of the end portion 32 and the top portion 41 include similar features. For example, the end portion 32 can have two outwardly extending concrete reinforcing members 62, 63 and the top portion 41 can have three outwardly extending studs, shown in profile in FIG. 5 as studs 67B, 67C, 67D, and three reinforcing members 65, respectively. The illustrated embodiment also includes a bent concrete reinforcing member 64 extending around and engaging the stud 67D. As shown, for example, by FIG. 7, the reinforcing member 64 can extend around and engage one or more corresponding studs on the housing 5 on the opposite side of the dock section. In other embodiments, one or more of the other studs, e.g., studs 67B, 67F, can be used to secure concrete reinforcing members in a similar fashion.

In many embodiments, several components of a connector 14, 14A, such as, for example, the housing, fasteners and tensioning mechanism, are formed of steel alloys. However, most steels are subject to corrosion, particularly in marine environments. Accordingly, connector components can be made from alloys of steel in combination with a surface treatment, such as galvanization, to deter corrosion. Other embodiments use metal alloys that are corrosion resistant.

Although floating dock sections are shown in the illustrated embodiment, one or more connectors 14 can be used to connect other types of flotation devices or water-borne structures to each other in the form of a wharf, floating bridge, or the like.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A connector for interconnecting first and second flotation devices, the connector comprising:

first and second bearing bodies coupled to the first and second flotation devices, respectively, the first and second bearing bodies being disposed in respective recesses in the first and second flotation devices;

a member disposed between the bearing bodies, the member comprising a unitary elastomeric shear bushing extending partially into the recess in the first flotation device and into the recess in the second flotation device, the shear bushing having first and second openings;

a first fastener held in tension and extending through the bearing bodies and the first opening of the shear bushing, wherein the first fastener applies a compressive load between the flotation devices that holds the shear bushing in compression; and a second fastener held in loose engagement relative to the bearing bodies and the shear bushing, the second fastener extending through the bearing bodies and the second opening of the shear bushing, wherein upon failure of the first fastener, the first and the second flotation devices separate sufficiently to place the second fastener in tension.

2. The connector of claim 1, wherein the shear bushing is placed in compression between the bearing bodies by the first fastener, and upon failure of the first fastener, the shear bushing is expandable so as to urge the first and the second flotation devices apart.

3. The connector of claim 1, wherein at least one of the bearing bodies comprises a steel plate.

4. The connector of claim 1, further comprising:

a compression member, through which the first fastener passes, capable of deforming under variable loading of the first fastener to allow a degree of movement between the dock sections.

5. The connector of claim 1, further comprising:

a housing defining a top portion, a bottom portion, a side portion and an end portion, wherein the side portion and the end portion extend perpendicularly to each other and between the top portion and the bottom portion;

wherein the first bearing body extends vertically between the top portion and the bottom portion; and wherein the housing is disposed in a recess formed in the first flotation device.

6. The connector of claim 5, wherein:

the top, the bottom and the side are formed by a U-shaped channel; and the end comprises a plate welded to the U-shaped channel.

7. The connector of claim 1, wherein at least one of the fasteners comprises a bolt.

8. The connector of claim 1 further comprising:

a tensioning mechanism for placing the first fastener in tension.

9. The connector of claim 8, wherein the tensioning mechanism comprises:

a first nut threadably engaging the first fastener; and a keeper nut threadably engaging the first fastener and tightened against the first nut to prevent the first nut from loosening.

10. A floating dock assembly comprising:

a first dock section;

a second dock section;

at least one connector assembly for connecting the first and the second dock sections to each other, the at least one connector assembly comprising first and second bolts spanning a joint between the dock sections, the first bolt being placed in tension to apply a compressive load between the dock sections, and the second bolt being held in loose engagement with the dock sections so as not to apply a load to the dock sections, wherein failure of the first bolt causes the second bolt to be placed in tension and apply a compressive load between the dock sections; and an elastomeric member disposed between the dock sections and held in compression by the compressive load between the dock sections, the elastomeric member extending partially into a recess in the first dock section and into a recess in the second dock section.

11. The floating dock assembly of claim 10, wherein the at least one connector assembly comprises first and second connector assemblies, each connector assembly comprising a respective first bolt and a respective second bolt.

12. The floating dock assembly of claim 10, further comprising:

a compression member disposed on the first bolt to minimize stress of the first bolt caused by relative movement between the dock sections.

13. A method of connecting first and second dock sections, the method comprising:

disposing a member between opposing first and second bearing bodies, the first bearing body disposed in a recess of the first dock section and the second bearing body disposed in a recess of the second dock section, the member extending partially into the recess of the first dock section and into the recess of the second dock section;

compressing the member between the bearing bodies with a first fastener; and loosely engaging the bearing bodies with a second fastener, wherein a first load on the first fastener maintains the member in compression and wherein the second fastener is placed under a second load on release of the first load.

14. The method of claim 13, wherein the member comprises an expandable member that can expand to at least partially place the second fastener under the second load.

15. The method of claim 13, wherein:

the first fastener comprises a bolt;

the first load comprises a tensile load;

the second fastener comprises a bolt; and the second load comprises a tensile load less than the first load.

16. The method of claim 13, further comprising:

placing the second fastener under a replacement load substantially the same as the first load; and replacing the first fastener with a third fastener, wherein the third fastener can be placed under a load substantially the same as the second load on release of the replacement load.

17. The method of claim 16, wherein:

the first fastener comprises a bolt and the first load comprises a tensile load;

the second fastener comprises a bolt and the replacement load comprises a tensile load; and, the third fastener comprises a bolt.

18. A flotation assembly comprising:

a first flotation device having a first bearing plate;

a second flotation device having a second bearing plate;

an elastomeric shear bushing disposed between the first and second bearing plates, the shear bushing extending partially into a recess in the first flotation device and into a recess in the second flotation device;

a first bolt extending through the first and the second plates and the bushing and held in tension such that the first and second plates apply compressive forces against opposing surfaces of the bushing and such that the bushing is held in compression between the first and second plates; and a second bolt extending through the first and second plates and the bushing and held in loose engagement such that, on failure of the first bolt, the second bolt is placed in tension.

19. The assembly of claim 18, further comprising a tensioning mechanism for holding the first bolt in tension, comprising:

a first nut engaging threads on the first bolt and tightened to place the first fastener in tension; and a keeper nut tightened against the first nut.

20. The assembly of claim 18, further comprising:

a cover pivotally connected to one of the flotation devices to provide access to one or more of the bolts.

21. The assembly of claim 18, further comprising:

a compression member through which the first bolt extends, wherein the first bolt further comprises a head disposed at an end of the bolt, and wherein the compression member is disposed on the first bolt between the head and the first plate and is capable of deforming under variable loading of the first bolt to minimize stress on the first bolt caused by relative movement between the flotation devices.

22. The assembly of claim 18, further comprising:

first and second housings disposed in respective recesses in the first and second flotation devices, respectively;

wherein the first and second bearing plates are secured to the first and second housings, respectively, and the bushing is at least partially disposed in the first and second housings.

23. The assembly of claim 18, wherein the first and second flotation devices are concrete structures.

24. The assembly of claim 18, wherein the bushing is configured to expand on failure of the first bolt.

25. A flotation assembly comprising:

a first flotation device defining a first pair of recesses on opposing sides of a first end thereof;

a second flotation device defining a second pair of recesses on opposing sides of a second end thereof, wherein the first and the second ends oppose each other, and each of the first pair of recesses opposes a corresponding one of the second pair of recesses;

at least four connector housings, wherein each connector housing is disposed in a corresponding recess to form at least two pairs of opposing connector housings;

a bearing body disposed within and secured to an inner surface of each connector housing;

wherein each pair of opposing connector housings houses a first bolt and a second bolt, the first bolt extending through the corresponding bearing bodies and placed in tension to apply a compressive load between the flotation devices, and the second bolt extending through the corresponding bearing bodies but held in loose engagement such that, on failure of the first bolt, the second bolt is placed in tension; and an elastomeric member corresponding to and disposed between each pair of opposing connector housings, the elastomeric member extending partially into the opposing connector housings, the first and second bolts of each pair of opposing connector housings extending through the corresponding elastomeric member, and the corresponding bearing bodies of each pair of opposing connector housings applying compressive forces against opposing surfaces of the elastomeric member such that the elastomeric member is held in compression between the bearing bodies.

* * * * *